US007918197B2

(12) United States Patent
Baek

(10) Patent No.: US 7,918,197 B2
(45) Date of Patent: Apr. 5, 2011

(54) VARIABLE VALVE SYSTEM

(75) Inventor: Hong Kil Baek, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 414 days.

(21) Appl. No.: 12/109,030

(22) Filed: Apr. 24, 2008

(65) Prior Publication Data

US 2009/0145383 A1 Jun. 11, 2009

(30) Foreign Application Priority Data

Dec. 6, 2007 (KR) ..... 10-2007-0126237

(51) Int. Cl.
*F01L 1/34* (2006.01)

(52) U.S. Cl. ..... 123/90.16; 123/90.48; 123/90.52

(58) Field of Classification Search ..... 123/90.16, 123/90.48, 90.52, 90.12
See application file for complete search history.

(56) References Cited

U.S. PATENT DOCUMENTS 5,351,662 A * 10/1994 Dopson et al. ..... 123/90.16
5,832,884 A * 11/1998 Haas et al. ..... 123/90.16

FOREIGN PATENT DOCUMENTS

JP 10-141030 A 5/1998

* cited by examiner

*Primary Examiner* — Zelalem Eshete
(74) *Attorney, Agent, or Firm* — Morgan, Lewis & Bockius LLP

(57) ABSTRACT

A variable valve system includes a camshaft in which a first lobe having a first height and a second lobe having a second height that is higher than the first height from a rotational center axis of the camshaft are formed; a first tappet that corresponds to the first lobe and that has a depression negatively formed in one side thereof; a second tappet corresponding to the second lobe and that is inserted into the depression; at least a pin positioned at the first tappet and fixing a position of the second tappet; and a hydraulic pressure control portion that transfers hydraulic pressure into the depression so as to move the second tappet upwards or downwards and to the pin so as to engage or disengage the first tappet with the second tappet.

16 Claims, 4 Drawing Sheets

VARIABLE VALVE SYSTEM

CROSS-REFERENCE TO RELATED APPLICATION

This application claims priority to and the benefit of Korean Patent Application No. 10-2007-0126237 filed in the Korean Intellectual Property Office on Dec. 6, 2007, the entire contents of which are incorporated herein by reference.

BACKGROUND OF THE INVENTION (a) Field of the Invention

The present invention relates to a valve system, more particularly, the variable valve system equipped with a variable tappet.

(b) Description of the Related Art

Generally, technical developments are ongoing in a variety of fields of the vehicle industry. Among them, a field for improving fuel efficiency of an engine is important in aspects of environment and energy saving.

An engine having CDA (cylinder de-activation) improves fuel efficiency by stopping function of some cylinders in an idle or low load driving condition.

FIGS. 1A and 1B show operating states of a valve system equipped with a general variable tappet.

As shown, the valve system is equipped with a variable tappet. The variable tappet is provided on an upper end portion of a stem 1*a* of a valve.

The variable tappet includes an inner tappet 3, an outer tappet 5, and a locking pin 7. First cams 13 and a second cam 11 are formed on a camshaft 9.

The first cams 13 correspond to the outer tappet 5, and the second cam 11 corresponds to the inner tappet 3.

The inner tappet 3 and the outer tappet 5 move together by the locking pin 7 as the locking pin 7 couples the outer tappet 5 and the inner tappet 3, referring to FIG. 1A. The stem 1*a* is moved by the first cams 13.

The inner tappet 3 and the outer tappet 5 may move separately, as the locking pin 7 is disengaged from the inner tappet 3, referring to FIG. 1B. The stem 1*a* is moved by the shorter second cam 11. Further, the outer tappet 5 compresses a lost spring 1*b*, so a movement of the stem 1*a* is restricted.

The locking pin 7 is operated by hydraulic pressure.

However, a movement of the valve by the first cam 13 is controlled by a movement of the outer tappet 5, so there is a problem in that the overall length (L) of the variable tappets 3 and 5 is increased.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a variable valve system having advantages of reducing length and weight of a variable tappet.

A variable valve system includes: a camshaft in which a first lobe having a first height and a second lobe having a second height that is higher than the first height from a rotational center axis of the camshaft are formed; a first tappet that corresponds to the first lobe and that has a depression negatively formed in one side thereof; a second tappet corresponding to the second lobe and that is inserted into the depression; at least a pin positioned at the first tappet and fixing a position of the second tappet; and a hydraulic pressure control portion that transfers hydraulic pressure into the depression so as to move the second tappet upwards or downwards and to the pin so as to engage or disengage the first tappet with the second tappet, wherein an upper end face of the second tappet facing the second lobe is inserted into the depression by as much as a predetermined distance or protrudes out of the depression by as much as a predetermined distance according to a hydraulic pressure transferred from the hydraulic pressure control portion to the depression.

The second tappet may be slidably coupled to an inner side of the depression, and the second tappet is elastically supported by a first spring.

The variable valve system may further comprise a second spring supporting the pin that connects or disconnects the first tappet and the second tappet in accordance with hydraulic pressure supplied from the hydraulic pressure control portion.

The variable valve system may further comprise a cylinder in which the pin is slidably coupled therein.

At least a protrusion for restricting movement of the pin inwards may be formed inside the cylinder and at least a groove into which an end portion of the pin is inserted may be formed on an inner surface of the first tappet.

The first lobes may be formed at both sides and the second lobe is formed between the first lobes and the depression is formed substantially in the middle of the first tappet.

The pin may be provided at both end portions of the second spring and a stem connected to a valve for opening a port may be supported and moved by the first tappet.

The hydraulic pressure control portion may include: a first oil path that fluidly communicates with the pin; and a second oil path that fluidly communicates between the pin and the depression.

The hydraulic pressure control portion may further include a third oil path that fluidly communicates with the first oil path and a lower portion of the depression.

As stated above, the length of a variable tappet is reduced and the weight thereof is small according to the valve system in an exemplary embodiment of the present invention. Accordingly, the valve system becomes compact and efficiency of an engine is improved.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1A:
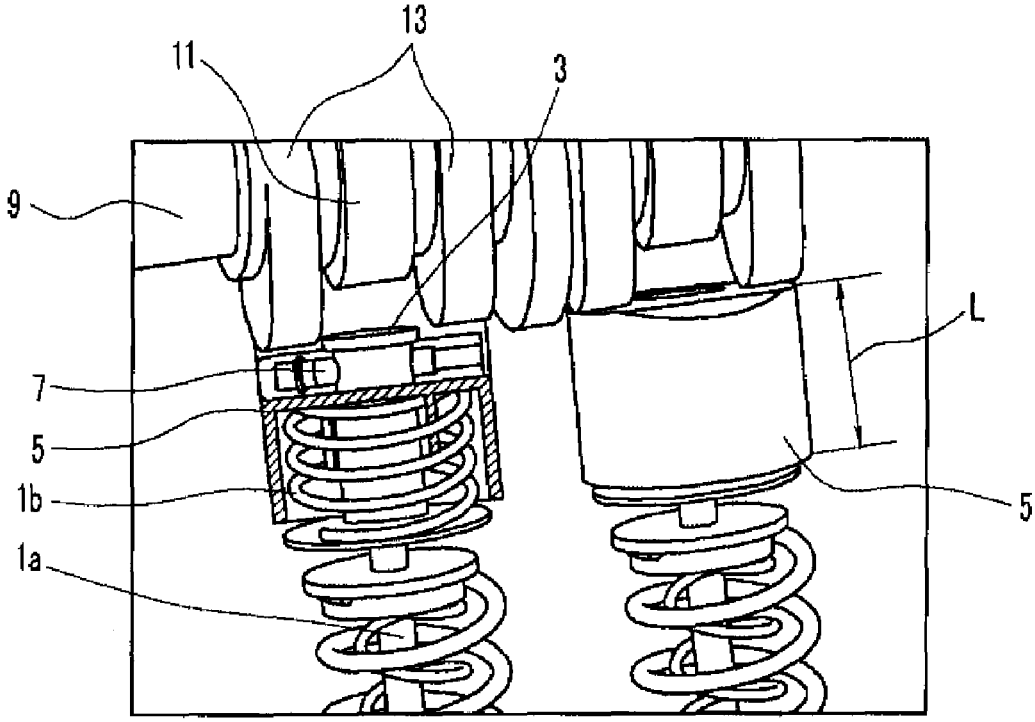
FIG. 1A shows a valve system equipped with a general variable tappet as locking pin couples outer tappet and inner tappet.
Figure 1B:
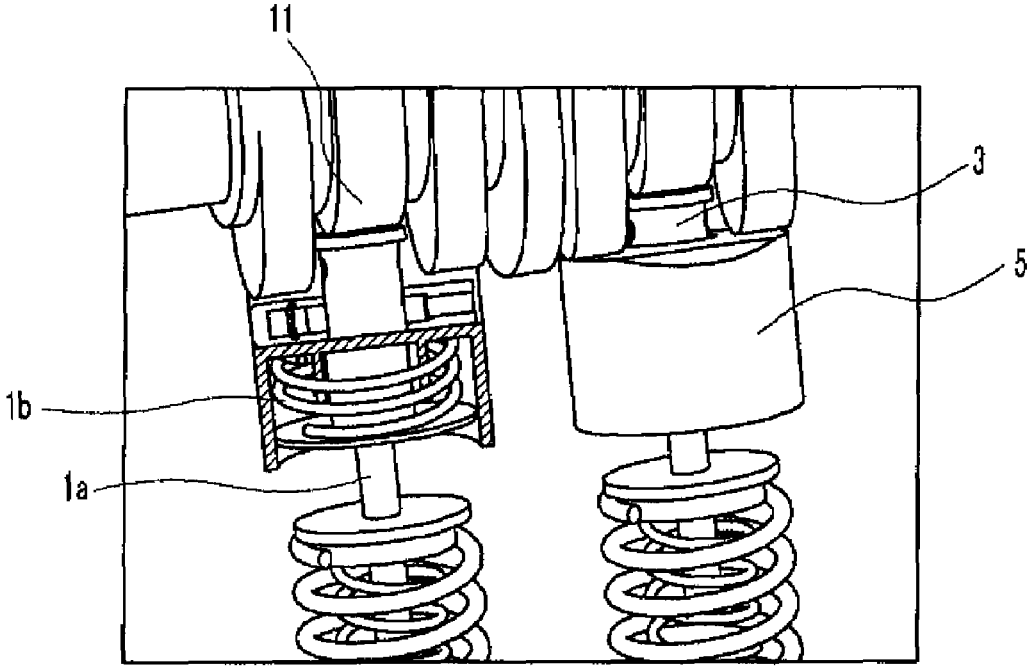
FIG. 1B shows a valve system equipped with a general variable tappet as locking pin is disengaged from inner tappet.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DESCRIPTION OF REFERENCE NUMERALS INDICATING PRIMARY ELEMENTS IN THE DRAWINGS

200: camshaft
202: stem
203: depression
204: valve
205: cam unit
210: first tappet
215: second tappet
220: first spring
225: supporting portion
230: pin
235: groove
240: second spring
250, 255: oil path

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The drawings and description are to be regarded as illustrative in nature and not restrictive. Like reference numerals designate like elements throughout the specification.

A valve system is explained according to an exemplary embodiment of the present invention referring to the accompanying drawings.

Figure 2:
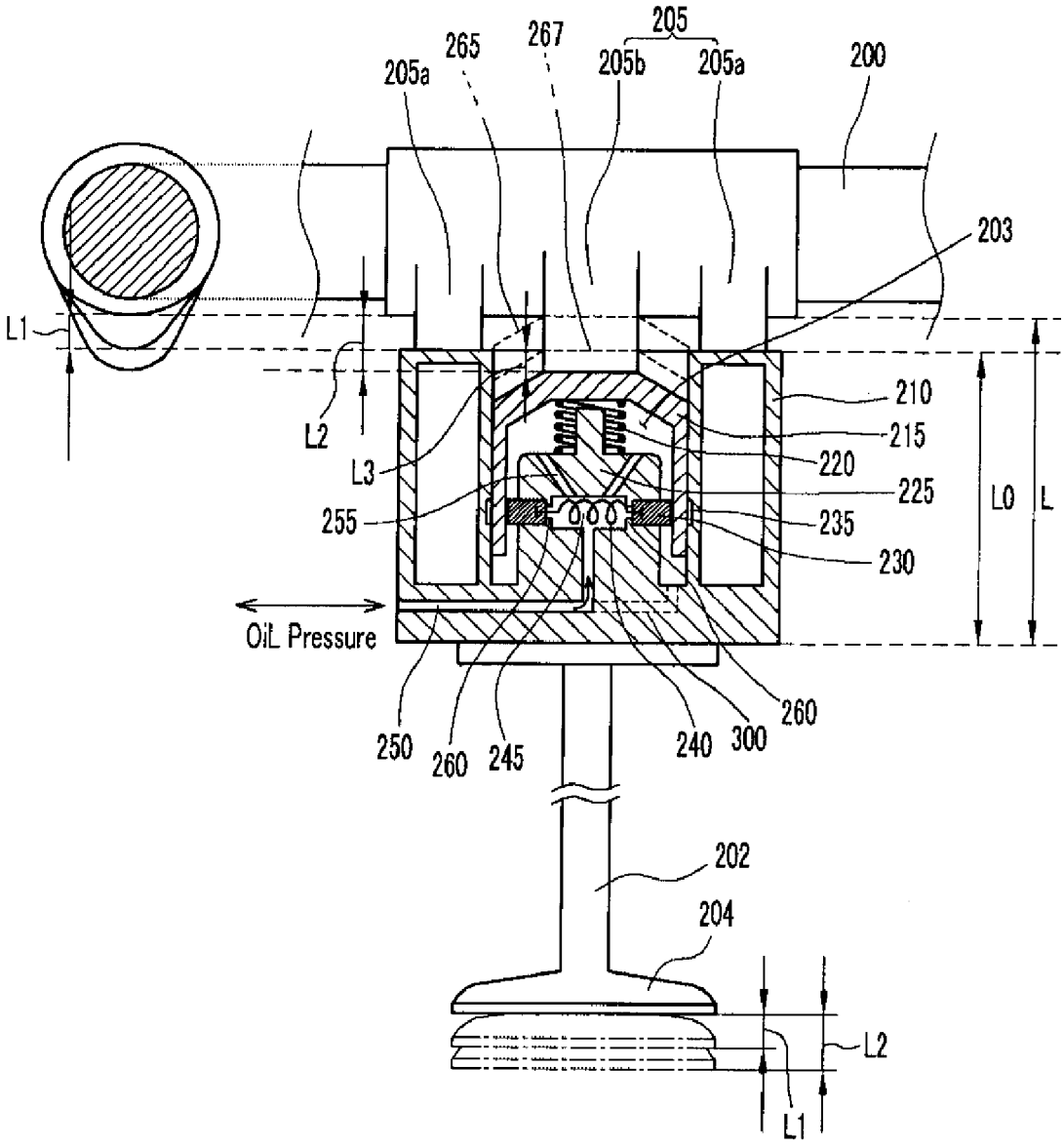
FIG. 2 is a cross-sectional view showing a first state of a valve system equipped with a variable tappet according to an exemplary embodiment of the present invention.

FIG. 2 is a cross-sectional view showing a first state of a valve system equipped with a variable tappet according to an exemplary embodiment of the present invention.

As shown in FIG. 2, a cam unit 205 is formed in a camshaft 200, and includes first lobes 205*a* and a second lobe 205*b*.

The first lobes 205*a* have a first height L1, and the second lobe 205*b* has a second height L2. Here the second height L2 is greater than the first height L1. Also, the first lobes 205*a* are formed at both sides of the cam unit 205, and the second lobe 205*b* is positioned between the first lobes 205*a*.

A first tappet 210, a second tappet 215, a stem 202, and a valve 204 are provided at a lower portion of the camshaft 200.

A depression 203 is negatively formed substantially in the middle of the first tappets 210, and the second tappet 215 is complementarily inserted in the depression 203. The stem 202 is directly connected to the first tappet 210. Further, the valve 204 for opening/closing a port of a cylinder is formed in a lower end portion of the stem 202.

The first tappet 210 corresponds to the first lobe 205*a* and the second tappet 215 corresponds to the second lobe 205*b* in the present exemplary embodiment.

A first oil path 250 and a second oil path 255 are formed in a lower portion of the first tappet 210. Hydraulic pressure is transferred inside the depression 203 through the first oil path 250 and the second oil path 255. The second tappet 215 moves in an upward direction or in a downward direction according to a supply of the hydraulic pressure.

A supporting portion 225 is formed inside the depression 203, and a first spring 220 is provided on the supporting portion 225. The first spring 220 elastically supports the second tappet 215.

A first space 245 is formed inside the supporting portion 225, and a second spring 240 is provided inside the first space 245. The first oil path 250 fluidly communicates with the first space 245, and the second oil path 255 is formed from the first space 245 to the depression 203 under the second tappet 215.

Figure 3:
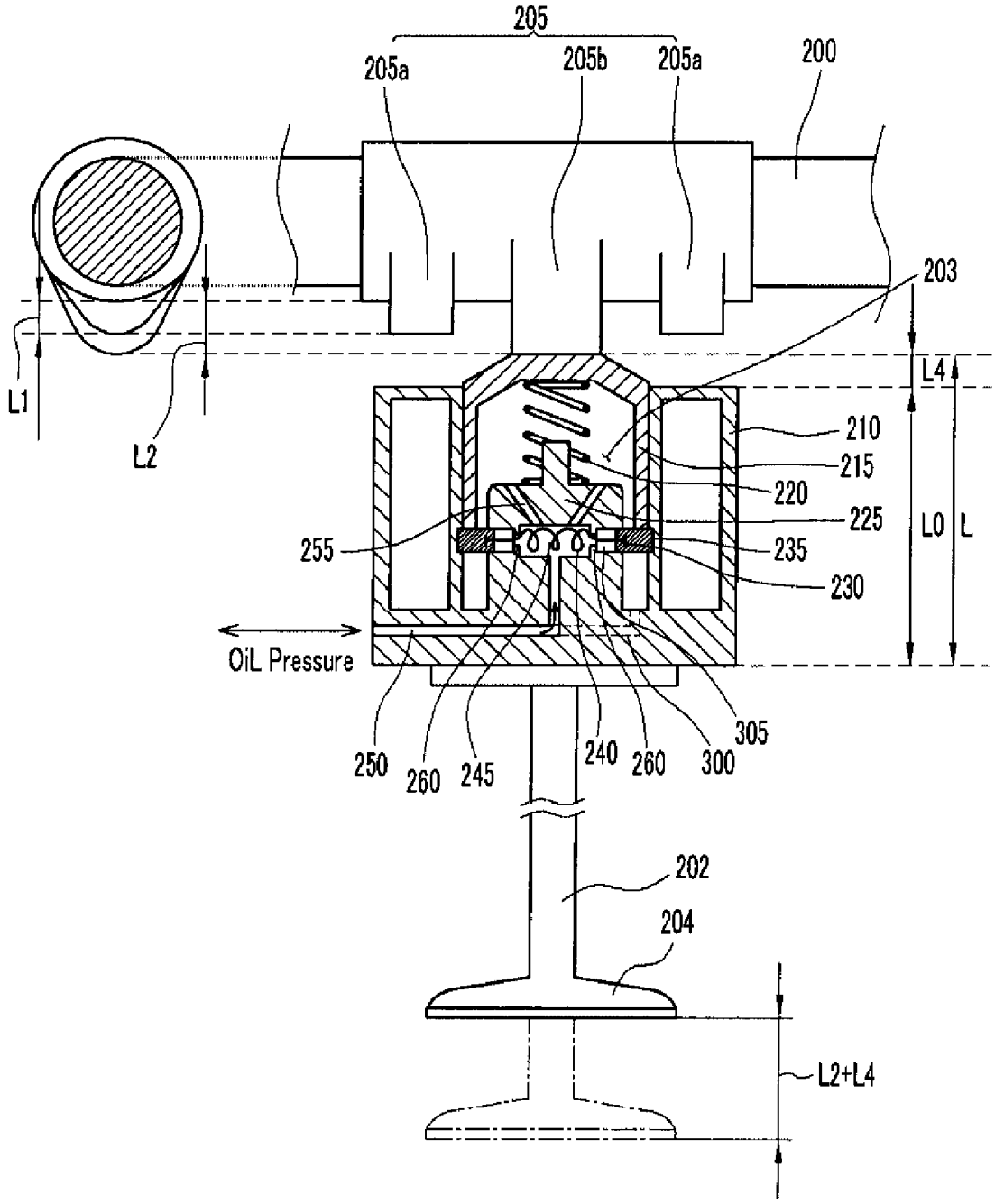
FIG. 3 is a cross-sectional view showing a second state of a valve system equipped with a variable tappet according to an exemplary embodiment of the present invention.

A cylinder 305 (referring to FIG. 3) is provided at both sides of the first space 245, and a pin 230 is installed in the cylinder 305 in FIG. 3. The pin 230 is connected or fixed to both end portions of the second spring 240.

The second spring 240 may elastically push the pin 230. At least a protrusion 260 is formed along an inner surface of the first space 245 and the movement of the pin 230 may be supported by the protrusion 260.

The hydraulic pressure is supplied to the first oil path 250 such that a pressure of the first space 245 and the depression 203 is increased. Accordingly, the second tappet 215 moves in an upward direction and then the pin 230 moves to a groove 235 formed at an inner surface of the first tappet 210.

The second tappet 215 is in a first state in FIG. 2. That is, an upper end face of the second tappet 215 is inserted as much as a third length L3 from an upper end face of the first tappet 210 inside the depression 203.

Further, the second tappet 215 is in a middle state (267) or a second state (265) according to a supply of the hydraulic pressure. An upper end face of the second tappet 215 has an equal height to an upper end face of the first tappet 210 in the middle state (267), and the upper end face of the second tappet 215 has a greater height of as much as L1 to the upper end face of the first tappet 210 in the second state (265).

The variable tappet according to an exemplary embodiment of the present invention has a length L0 in the first state and a length L in the second state. The variable tappet according to the present exemplary embodiment has a shorter length of as much as L1 compared to a general variable tappet.

FIG. 3 is a cross-sectional view showing a second state of a valve system equipped with a variable tappet according to an exemplary embodiment of the present invention.

As shown in FIG. 3, the second tappet 215 moves up by the hydraulic pressure that is supplied inside the depression 203. Also, as a pressure of the first space 245 rises, the second spring 240 is elastically extended and the pins 230 move toward the first tappet 210 as explained hereinafter in detail.

At least a groove 235 (referring to FIGS. 2 and 3) may be formed in a lower portion of an inside surface of the first tappet 210 as an exemplary embodiment of the present invention. As a pressure to the first space 245 and depression 203 rises, the second tappet 215 moves upwards, the second spring 240 in the first space 245 is elastically extended and some portions of the pins 230 are inserted into the groove 235. Accordingly, the pins 230 support a lower end portion of the second tappet 215 and thus restrict the downward movement of the second tappet 215.

As shown, the second tappet 215 protrudes from the upper end face of the first tappet 210 by as much as a fourth length L4. Accordingly, the variable tappet has an extended length L according to the present exemplary embodiment. Therefore, a distance that the stem 202 and the valve 204 move is equal to the length of the second length L2 plus the fourth length L4.

The hydraulic pressure can be supplied through the first oil path 250, the first space 245, and the second oil path 255 to the depression 203. As another exemplary embodiment, a third oil path 300 may be further formed in a lower portion of the first tappet 210 as shown in FIGS. 2 and 3 and thus the hydraulic pressure can be directly supplied to the depression 203 through the first oil path 250 and the third oil path 300.

However, when the hydraulic pressure descends through the first oil path 250, the pins 230 are drawn out of the groove 235. Further, the pins 230 move in a central direction to the protrusions 260 where the first space 245 is formed. The second tappet 215 descends when the pressure in the depression 203 falls.

Figure 4:
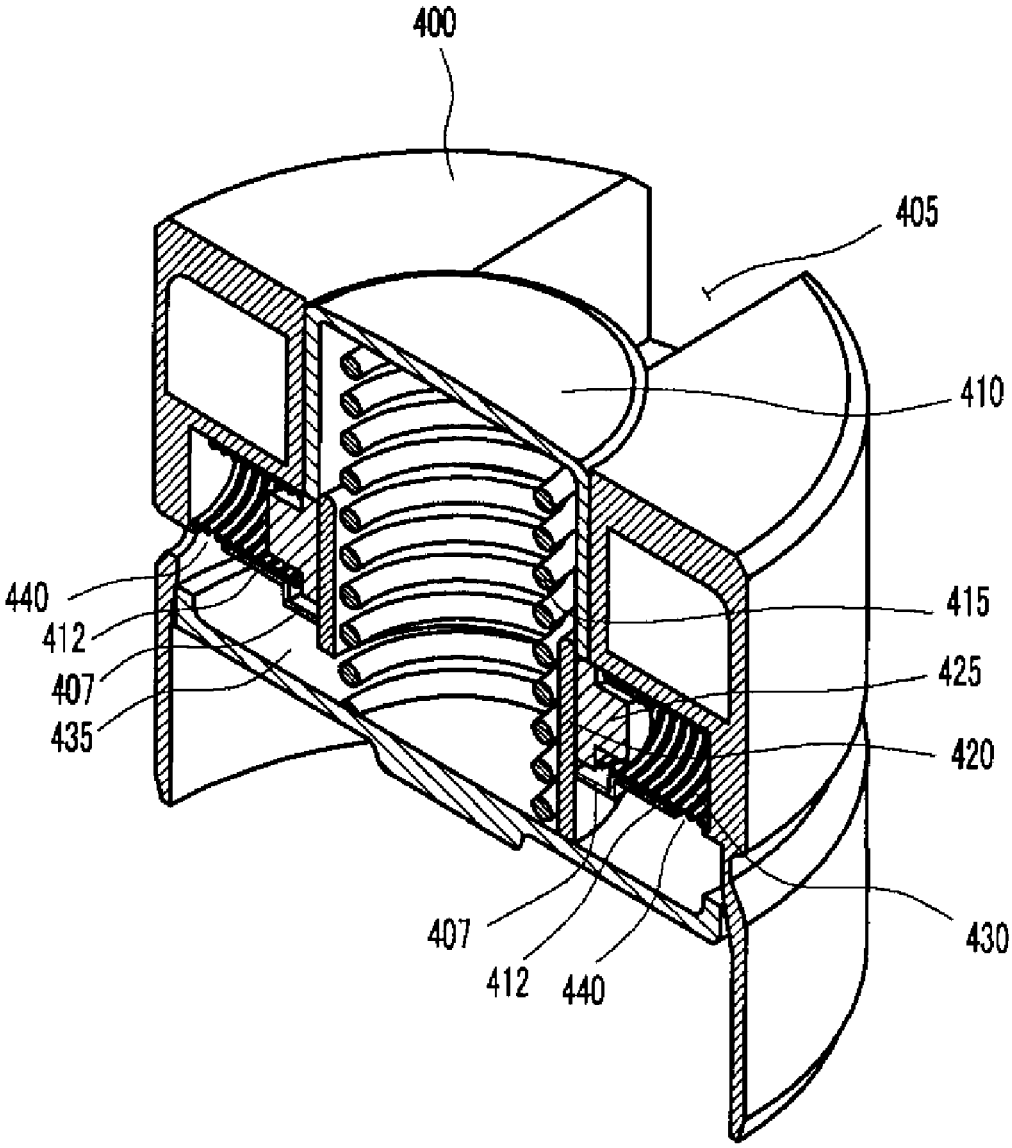
FIG. 4 is a cross-sectional view showing a valve system equipped with a variable tappet according to another exemplary embodiment of the present invention.

FIG. 4 is a cross-sectional view showing a valve system equipped with a variable tappet according to another exemplary embodiment of the present invention.

As shown FIG. 4, a variable tappet according to another exemplary embodiment of the present invention includes a first tappet 400, a groove portion 405, a second tappet 410, at least a cylinder 412, an inner guide 420, a first spring 415, at least a second spring 430, at least a pin 425, an oil path 435 and a second oil path 440.

Groove portion 405 is formed at upper end portion of the first tappet 400, traversing the center portion of the first tappet 400. The second tappet 410 is assembled substantially at the center portion of the first tappet 400. In the instant embodiment, the first lobe 205*a* is placed on upper portion of the first tappet 400 and the second lobe 205*b* is placed on the second tappet 410 positioned in the groove portion 405 of the first tappet 400.

The inner guide 420 is positioned in the second tappet 410 and outer circumference of the inner guide 420 is substantially fit into the inner circumference of the second tappet 410 as shown FIG. 4.

First spring 415 is provided inside the second tappet 410 and thus supports elastically the second tappet 410.

Lower portion of the inner guide 420 is fixed to lower portion of the first tappet 400 and thus only the second tappet 410 moves up and down by the supplied hydraulic pressure as explained hereinafter.

The cylinder 412 is formed substantially in the middle portion of the first tappet 400 and includes a guide 407 at one end of the cylinder 412 wherein the guide 407 is substantially near to inner circumference of the first tappet 400.

At least a pin 425 is provided inside the guide 407 and the second spring 430 attached to an end of the pin 425 is provided in the cylinder 412 wherein the other end of the second spring 430 is attached to the other end of the cylinder 412. The second spring 430 is an extension spring for proving a restoring force.

A second oil path 440 is provided at the other end of the cylinder 412, fluidly communicating with the oil path 435 which supplies external hydraulic pressure to the pin 425.

From this configuration, while hydraulic pressure is not supplied through the oil path 435 and the second oil path 440, the pin 425 stays inserted into the cylinder 412 by a restoring force of the second spring 430. Accordingly the second tappet 410 may move up and down along the inner circumference of the first tappet 400.

In contrast, as the hydraulic pressure increases in the oil path 435 and the second oil path 440, the second tappet 410 moves up by a hydraulic pressure supplied through the oil path 435 along a gap between the first tappet 400 and the inner guide 420 as shown FIG. 4.

When the hydraulic pressure in the cylinder 405 increases sufficiently enough to overcome the restoring force of the second spring 430, the pin 425 in the guide 407 of the cylinder 412 moves to the outer circumference of the inner guide 420 to a central direction of the inner guide 420 and thus the second tappet 410 that already moved up is locked by the pin 425. The height of the second tappet 410 may be substantially the same as the height of the top portion of the first tappet 400 when the second tappet 410 is fully extended by external hydraulic pressure in an exemplary embodiment of the present invention.

In contrast, as the hydraulic pressure in the cylinder 412 decreases, the pin 425 moves into the cylinder 412 by a restoring force of the second spring 430 such that the second tappet 410 moves down.

Accordingly, when the second tappet 410 moves up, the lift amount of a valve is increased, and when the second tappet 410 moves down, the lift amount of a valve decreased.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve system comprising:

a camshaft in which a first lobe having a first height and a second lobe having a second height that is higher than the first height from a rotational center axis of the camshaft are formed;

a first tappet that corresponds to the first lobe and that has a depression negatively formed in one side thereof;

a second tappet corresponding to the second lobe and that is inserted into the depression;

at least a pin positioned at the first tappet and fixing a position of the second tappet; and a hydraulic pressure control portion that transfers hydraulic pressure into the depression so as to move the second tappet upwards or downwards and to the pin so as to engage or disengage the first tappet with the second tappet;

wherein an upper end face of the second tappet facing the second lobe is inserted into the depression by as much as a predetermined distance or protrudes out of the depression by as much as a predetermined distance according to a hydraulic pressure transferred from the hydraulic pressure control portion to the depression;

wherein the hydraulic pressure control portion comprises:

a first oil path that fluidly communicates with the pin; and a second oil path that fluidly communicates between the pin and the depression.

2. The variable valve system of claim 1, wherein the second tappet is slidably coupled to an inner side of the depression, and the second tappet is elastically supported by a first spring.

3. The variable valve system of claim 1, further comprising a second spring supporting the pin that connects or disconnects the first tappet and the second tappet in accordance with hydraulic pressure supplied from the hydraulic pressure control portion.

4. The variable valve system of claim 3, further comprising a cylinder in which the pin is slidably coupled therein.

5. The variable valve system of claim 4, wherein at least a protrusion for restricting movement of the pin inwards is formed inside the cylinder.

6. The variable valve system of claim 3, wherein at least a groove into which an end portion of the pin is inserted is formed on an inner surface of the first tappet.

7. The variable valve system of claim 1, wherein the first lobes are formed at both sides and the second lobe is formed between the first lobes.

8. The variable valve system of claim 1, wherein the depression is formed substantially in the middle of the first tappet.

9. The variable valve system of claim 3, wherein the pin is provided at both end portions of the second spring.

10. The variable valve system of claim 3, wherein a stem connected to a valve for opening a port is supported and moved by the first tappet.

11. The variable valve system of claim 1, wherein the hydraulic pressure control portion further comprises a third oil path that fluidly communicates with the first oil path and a lower portion of the depression.

12. The variable valve system of claim 3, wherein the pin is in a cylinder disposed in the first tappet and is supported by the second spring to a central direction of the second tappet, wherein the second spring is positioned in the cylinder.

13. The variable valve system of claim 12, an inner guide is disposed inside the second tappet, wherein the inner guide is fixed on a lower portion of the first tappet and the first and second tappets fluidly communicate with an oil path.

14. The variable valve system of claim 13, the pin is positioned in a guide formed at an end of the cylinder, and the pin is provided on end portion of the second spring in the cylinder and the cylinder fluidly communicates with a second oil path fluidly communicating with the oil path.

15. The variable valve system of claim 14, wherein the second spring is an extension spring.

16. The variable valve system of claim 15, wherein the first tappet includes a groove portion formed at upper end portion of the first tappet, traversing center portion of the first tappet and receive the second lobe.

* * * * *